US006375257B1

(12) United States Patent
Wooding et al.

(10) Patent No.: US 6,375,257 B1
(45) Date of Patent: Apr. 23, 2002

(54) CHAIR TABLET ARM APPARATUS

(75) Inventors: Peter Wooding, Providence, RI (US); Joan Burgasser, York, PA (US); Mark Blackgrave, Jasper; John Stutsman, Otwell, both of IN (US); Gregory Saul, Charlotte, NC (US)

(73) Assignee: JOFCO, Inc., Jasper, IN (US)

( * ) Notice: Subject to any disclaimer, the term of this patent is extended or adjusted under 35 U.S.C. 154(b) by 0 days.

(21) Appl. No.: 09/592,136

(22) Filed: Jun. 12, 2000

(51) Int. Cl.[7] ..... A47B 39/00; A47B 83/62

(52) U.S. Cl. ..... 297/162; 297/161; 297/173; 248/218.4; 248/227.3; 248/278.1

(58) Field of Search ..... 297/160, 161, 297/162, 170, 171, 172, 173; 248/218.4, 227.3, 278.1, 284.1, 183.2

(56) References Cited

U.S. PATENT DOCUMENTS

| | | | | |
|---|---|---|---|---|
| 3,265,436 A | * | 8/1966 | Bombard et al. | 297/162 |
| 4,159,846 A | | 7/1979 | Tolleson | |
| 4,216,994 A | | 8/1980 | Benoit | |
| 4,591,206 A | | 5/1986 | Pribble | |
| 4,848,833 A | | 7/1989 | Grall | |
| 4,852,940 A | | 8/1989 | Kanigowski | |
| 4,861,102 A | * | 8/1989 | Fuller | 297/162 |
| 5,139,309 A | | 8/1992 | Kornreich | |
| 5,169,210 A | * | 12/1992 | Fricano | 297/170 X |
| 5,683,136 A | | 11/1997 | Baumann et al. | |
| 5,765,911 A | | 6/1998 | Sorenson | |
| 5,845,964 A | | 12/1998 | Poon | |
| 5,865,124 A | | 2/1999 | Wroe | |
| D409,860 S | | 5/1999 | Best | |
| 5,931,528 A | | 8/1999 | Shields | |

* cited by examiner

*Primary Examiner*—Anthony D. Barfield
(74) *Attorney, Agent, or Firm*—Maginot, Moore & Bowman, LLP

(57) ABSTRACT

A tablet arm apparatus providing a re-positionable and stowable tablet work surface which is easily mounted on a chair or integrated into a chair design is described in which movement in each axis is independent and is accomplished by an articulating arm assembly or a single inexpensive two-axis hub.

9 Claims, 9 Drawing Sheets

CHAIR TABLET ARM APPARATUS

BACKGROUND OF THE INVENTION

The present invention relates to a tablet arm for furniture, particularly a chair. More specifically, the invention concerns a work tablet that mounts to a chair and uses an assembly having two or more degrees of freedom to pivot and rotate the tablet from a vertical stowed position at the side of the chair to an deployed position above and parallel to the seat of the chair.

A number of chair tablet designs have a mechanism that support the work tablet in a first horizontal position over the chair seat and in a second stowed position when the tablet is not in use. However, few designs have provided an apparatus that can be integrated into the chair design and that allow repositioning of the tablet from above the chair seat to a position to the side of the chair by both rotating the tablet from the horizontal plane to the vertical plane or, when the tablet is in use, by merely swinging the tablet in the horizontal plane. Further, as an easily mountable accessory to a chair, none of the existing tablet designs provide rotation of the tablet from the horizontal plane to the vertical plane and independent rotation in the vertical plane to a stowed position along the side of the chair using a single inexpensive two-axis hub.

One design that provides a horizontal tablet position above a chair and repositions to a stowed vertical position at the side of the chair is Bauman et al., U.S. Pat. No. 5,683,136. The tablet must be pivoted from the horizontal to the vertical plane using one pivot joint then slid to a position along the side of the chair using a slide mechanism. This design does not allow repositioning of the tablet without rotating it from the horizontal plane, nor does it allow the tablet to be rotated within the horizontal plane.

Two designs that use angled pivot joints for positioning are Benoit, U.S. Pat. No. 4,216,994, and Phoon, U.S. Pat. No. 5,845,964. The angled pivot joints cause the tablet to be rotated through the horizontal and vertical planes simultaneously. Other designs, such as the patent to Sorenson, U.S. Pat. No. 5,765,911, allow motion in one plane independent of the other and movement of the tablet without upsetting its horizontal position. However, such designs require manual loosening and re-tightening of friction brakes before and after repositioning.

The alternative design of Kanigowski, U.S. Pat. No. 4,852,940, provides multiple axis motion using a single ball-joint, but fails to provide integral stops or locks. In order to maintain a horizontal position, the chair arms or a shelf extending from them must support the tablet. A design patent to Best, U.S. Pat. No. 409,860,illustrates a mountable accessory, requiring two mounting bars and two single-axis pivot joints to provide repositioning to a stowed position.

In light of the shortcomings of these prior devices, there remains a need for a tablet arm apparatus that allows the tablet to rotate to a vertical position or to move through the horizontal plane without upsetting the other plane of motion and without having to fully stow the tablet for a person to enter or exit of the seat of the chair while requiring only one mount and one inexpensive two-axis joint and furthermore, not requiring manual friction brakes to lock an axis of motion of the tablet.

SUMMARY OF THE INVENTION

Briefly describing one aspect of the invention, the work tablet arm apparatus includes a tablet plate for mounting a work tablet and an articulating arm assembly providing various tablet positions and configured for attachment of the apparatus to a chair.

The difficulties with prior chair tablet arm apparatuses are overcome in one aspect of the current invention by the articulating arm assembly. The arm assembly in one embodiment includes a pivot rod assembly connecting one end of a long arm to one end of a short arm. The other end of the long arm can be rotationally connected to the tablet plate using a slotted washer and stop pin combination that allows limited rotation of the tablet independent of the arm position. The other end of the short arm can be pivotably mounted to the chair arm, preferably as an integral element of the chair design. In one aspect of this embodiment, the short arm pivot provides a means for moving the tablet from a position over the seat of the chair to the front of or other side of the arm of the chair. This pivot allows a person to enter or exit the seat without having to fully stow the tablet and without upsetting the contents of the tablet.

In a further aspect, the pivot rod assembly provides a means for rotating the tablet and long arm about an axis parallel with the chair seat. The pivot rod assembly can include a bias spring for engaging a locking pin into a locking notch, stopping rotation of the long arm when the tablet is parallel to the chair seat. The long arm rotation about the pivot rod provides for quick movement of the tablet when it is not in use. When combined with a pivot to the outside of the arm of the chair, the long arm also provides for stowing the tablet in a vertical position along the outside of the arm of the chair. The chair tablet arm apparatus requires no manual friction brakes and no external support of the tablet other than a single mounting point.

In another embodiment of the invention a chair tablet arm apparatus is provided as an accessory to an existing chair design and is capable of two-axis motion using a single inexpensive hub and a single mounting bracket. The chair tablet arm apparatus in this embodiment can include a tablet plate, a pivot hub assembly, a mounting bar, and a mounting bracket. The mounting bracket can function to attach the apparatus to an existing member of the chair such as a chair leg. The mounting bar rotationally attaches the mounting sleeve to the pivot hub assembly. The pivot hub can be pivotably attached to the tablet plate.

The pivot hub assembly can include spring-biased pins that engage the mounting bar, and are operable to stop rotation of the hub around the mounting bar when the tablet is at a rotational position for pivoting. The tablet plate can then pivot between a position perpendicular to a position parallel to the chair seat. In the perpendicular position, the tablet can rotate independently within the perpendicular plane to a stowed position at the outside of the chair member to which the apparatus is attached.

One object of the invention is to provide a stowable tablet arm apparatus that can be readily integrated into an existing chair using a single mounting point. Another object is to such a tablet arm apparatus that can provide two-axis motion using a single inexpensive joint.

One benefit is that the tablet can be rotated to a vertical position or moved through the horizontal plane without upsetting the other plane of motion and without having to fully stow the tablet for a person to enter or exit the seat of the chair. Another benefit is that the apparatus requires no manual friction brakes to lock an axis of motion of the tablet.

These and other objects, advantages, and features are accomplished according to the devices, assemblies, and methods of the present invention.

DESCRIPTION OF THE PREFERRED EMBODIMENTS

Figure 1:
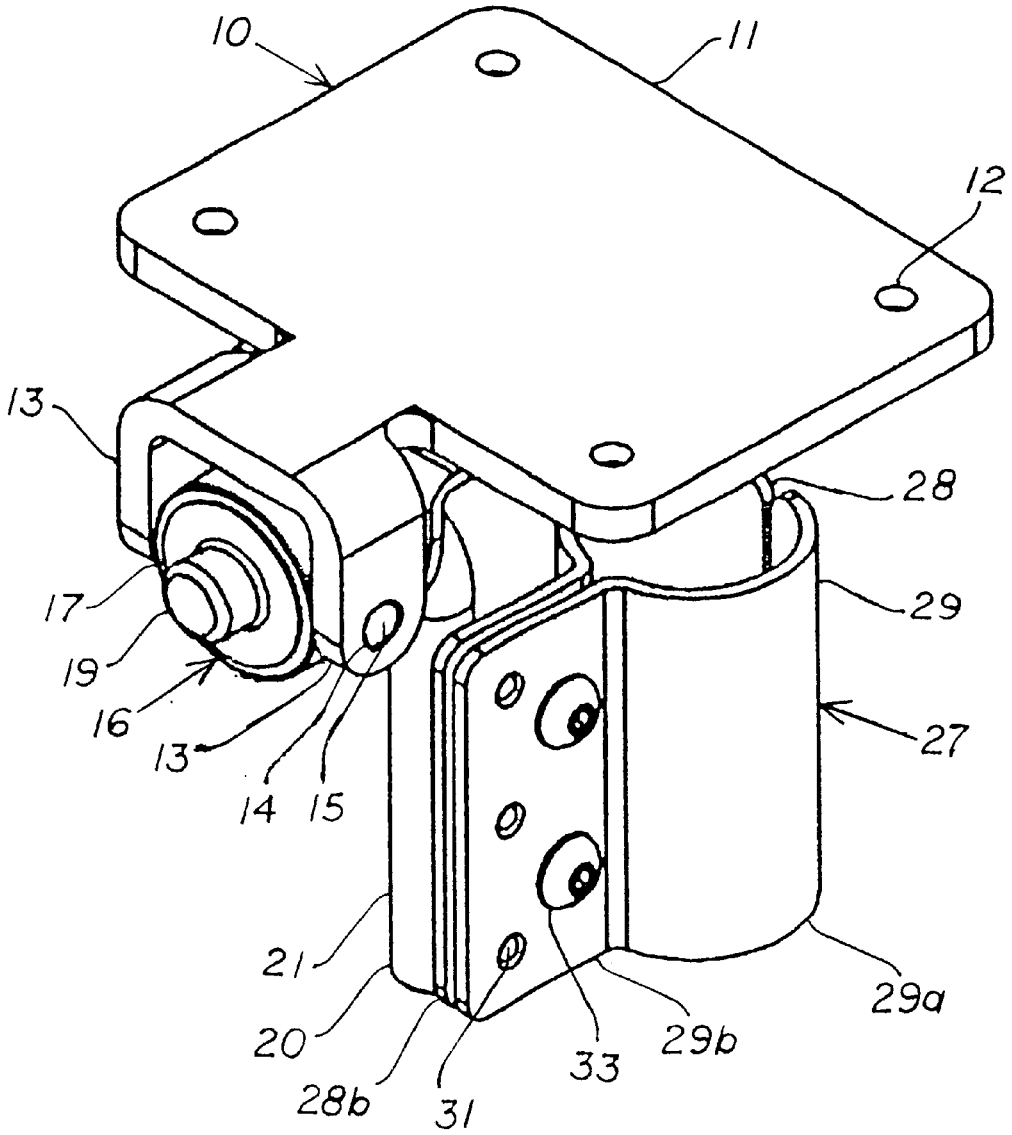
FIG. 1 is a perspective view of a chair tablet arm apparatus according to one embodiment of the invention, utilizing a single pivot hub assembly and shown in a deployed position.

For the purposes of promoting an understanding of the principles of the invention, reference will now be made to the embodiments illustrated in the drawings and specific language will be used to describe the same. It will nevertheless be understood that no limitation of the scope of the invention is thereby intended. The invention includes any alterations and further modifications in the illustrated devices and described methods and further applications of the principles of the invention which would normally occur to one skilled in the art to which the invention relates.

The present invention relates to a tablet arm apparatus for furniture, particularly a chair. More specifically, the invention concerns a work tablet that mounts to a chair and uses an assembly having two or more degrees of freedom to pivot and rotate the tablet from a vertical stowed position at the side of the chair to a deployed position above and parallel to the seat of the chair.

Figure 4:
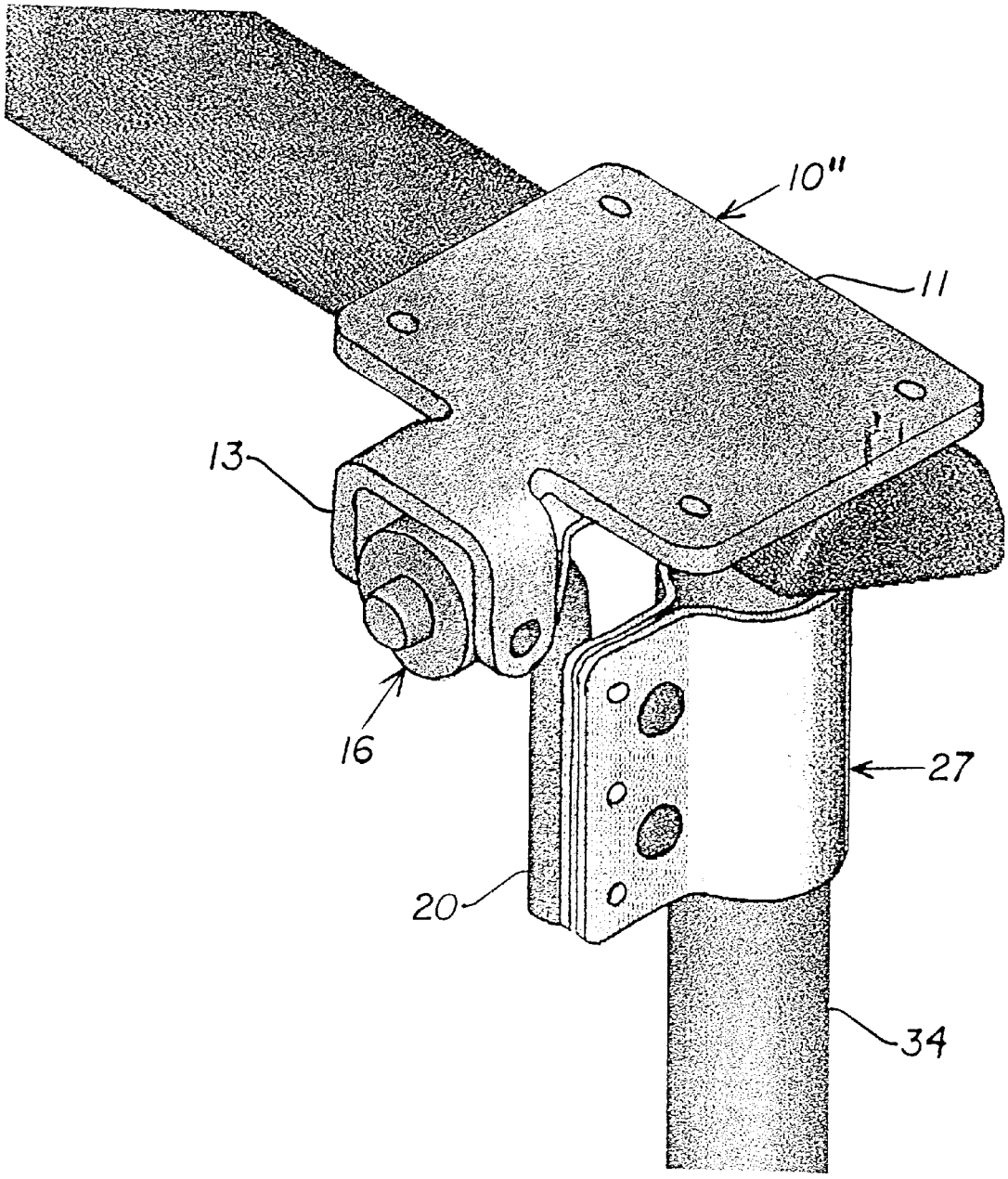
FIG. 4 is a perspective view of the chair tablet arm apparatus of FIG. 1 mounted on a chair and in a deployed position.
Figure 5:
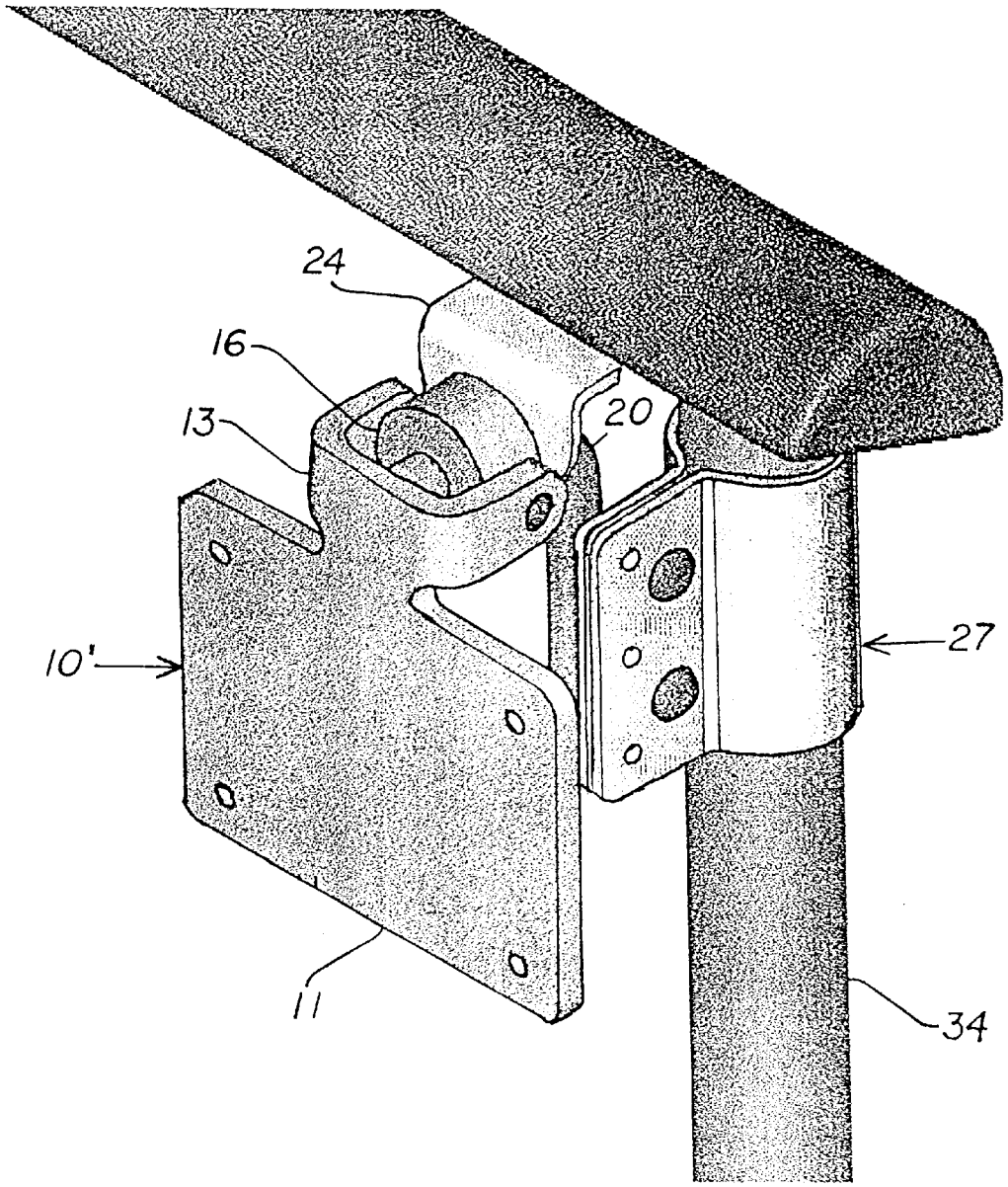
FIG. 5 is a perspective view of the chair tablet arm apparatus depicted in FIG. 1 but shown in a stowed position.

In accordance with one embodiment of the present invention, a chair tablet arm apparatus 10 is shown in FIG. 1 and as attached to a chair in FIG. 4. The apparatus 10 contemplates a tablet plate 11 pivotably attached to a pivot hub assembly 16, which is itself rotationally attached to a mounting bar 20. The apparatus 10 can be generally constructed of plastic or lightweight metal and can be attached to a member of a chair, such as a chair leg, with a mounting bracket 27 as depicted in FIG. 4. The apparatus is movable from a deployed position 10" (FIG. 4) above and parallel to the seat of the chair, and a vertical stowed position 10' at the side of the chair as depicted in FIG. 5. The stowed position 10' facilitates easy access to or exit from the seat of the chair. The deployed position 10" provides a work surface functional to a person seated in the chair.

Figure 2:
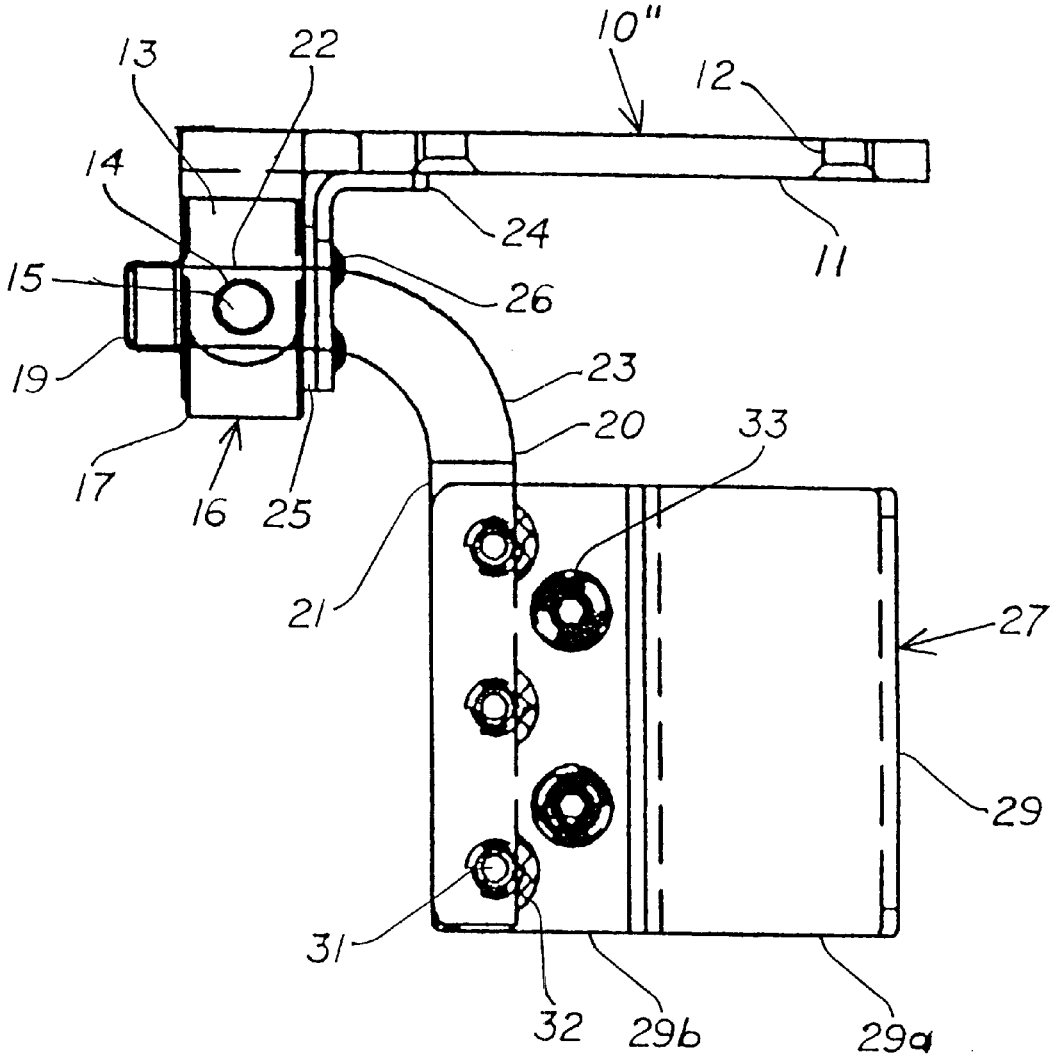
FIG. 2 is a front elevational view of the chair tablet arm apparatus depicted in FIG. 1.

Referring to FIGS. 1 and 2, the mounting bracket 27 in one specific embodiment preferably includes two opposing "C" clamp portions 28 and 29. Each clamp portion 28 and 29 defines a curved portion 28*a* and 29*a* forming a half cylinder, and a flat flange 28*b* and 29*b* extending the length of one end of the cylinder. The flange 28*b* of clamp portion 28 is attached to a long arm 21 of the mounting bar 20, preferably at three weld points 32. The apparatus 10 can be mounted to a chair leg, as depicted in FIG. 4, by first positioning the clamp portion 28 with the half cylinder 28*a* in contact with one side of the chair leg. The second clamp portion 29 is then placed in juxtaposed mirror image fashion so that the two half cylinders 28*a* and 29*a* cooperate to enclose the chair leg. Three alignment dimples 31 defined between the two flanges 28*b* and 29*b* align the clamp portions and the portions are drawn together by a number of screws 33. The screws 33 and dimples 31 cooperate to allow the clamp portions 28 and 29 to firmly grip the chair leg. The interior of the half cylinder portions 28*a* and 29*a* of each clamp 28 and 29 is preferably lined with foam tape 30 to provide a firm attachment to the chair member 34.

The mounting bar 20 extends from a long arm 21 through a 90-degree bend 23 to a short arm 22. The pivot hub assembly 16 can include a bearing hub 17, a retaining nut 19, a rest bracket 24, and a washer 25. The hub assembly 16 is rotationally mounted on the short arm 22 of the mounting bar 20, with the end 22 passing through a central opening 18 (FIG. 3) of the hub 17. The retaining nut 19, which is preferably a cap nut, can be attached to the short arm 22 of the mounting bar to trap the hub 17 between the retaining nut 19 and the washer 25 and rest bracket 24. The rest bracket 24 is preferably fixed to the short arm 22, such as at weld points 26. The washer 25 provides a sliding surface for the hub 17 relative to the rest bracket 24. In the deployed position 10" depicted in FIG. 2, the tablet plate 11 is supported by the rest bracket 24 in a generally horizontal attitude.

Referring to FIG. 1, the tablet plate 11 has a flat surface having multiple mounting holes 12 defined therethrough by which a solid work surface may be attached. The plate further includes a pair of mounting ears 13 forming a U-shape extend from one end thereof. The mounting ears 13 are spaced apart to receive the pivot hub 17 within the U-shape.

Figure 3:
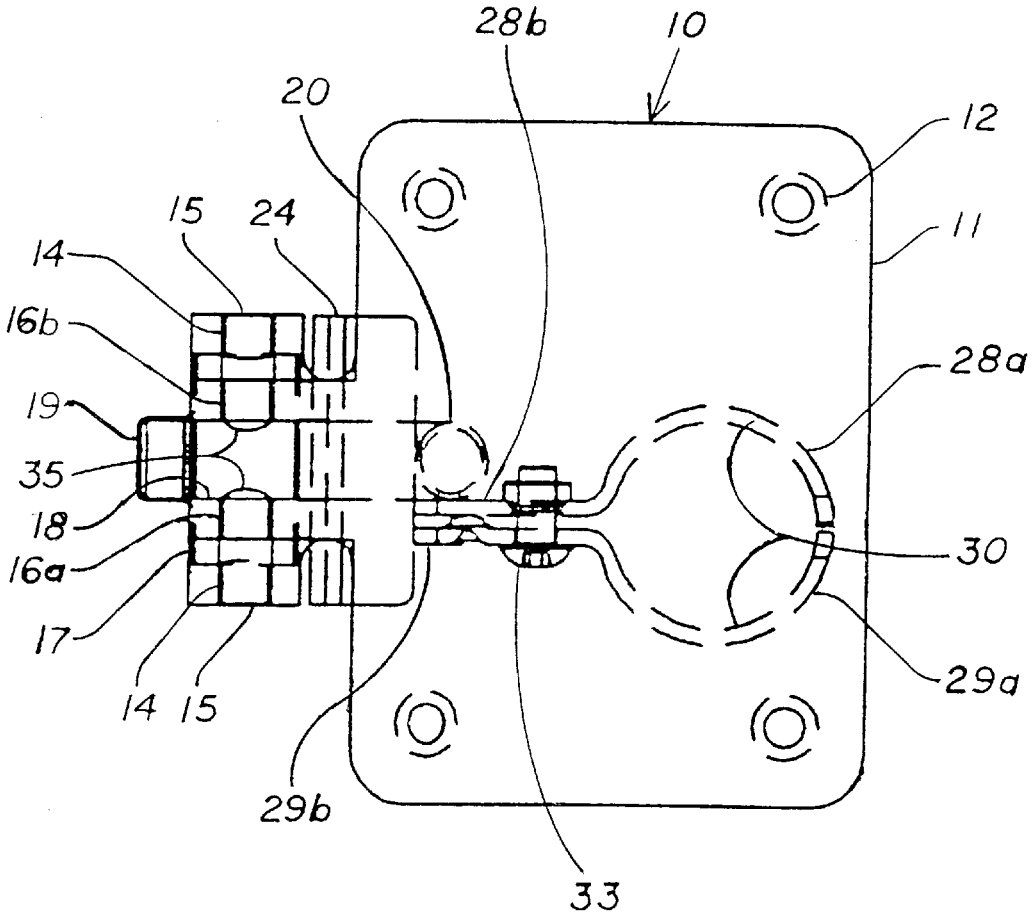
FIG. 3 is a top view of the chair tablet arm apparatus depicted in FIG. 1.

Each mounting ear 13 defines a co-linear thru-hole 14. The thru-holes are sized to receive a corresponding spring pin 15 therein, with each pin extending toward the interior of the U-shape. The spring pins 15 can extend through opposite walls 17*a* and 17*b* of the hub 17, as depicted in FIG. 3, to mount the tablet plate 11 to the hub for rotation therewith. At a rotational position in which the tablet plate 11 is in a plane sharing one axis with the chair seat, the spring pins 15 can engage detents 35 defined on opposite sides of the short arm 22 of mounting bar 20. The detents 35 cooperate with the ends of the pins 15 to resist rotation of the hub 17 and tablet plate when the pins reside within the detents. However, the spring pins are configured to allow the ends of the pins to slide out of the detents upon application of a moderate force rotating the hub 17 relative to the short arm 22. The tablet plate 11 remains free to pivot about the axis of the spring pins 15, and relative to the hub, permitting movement of the tablet plate between a horizontal and vertical position.

The hub 17 is preferably formed substantially entirely of nylon or a similar low-friction material. Most importantly, the hub opening 18 must have a low friction characteristic so that the hub, and therefor the tablet plate 11, can freely rotate about the mounting bar. Likewise, the pin bores 16*a* and 16*b* must have a low friction characteristic so that the spring pins can pivot freely as the tablet plate is pivoted relative to the hub. In addition, the spring pins must be able to freely translate axially toward the detents 35 in the mounting bar.

The operation of the chair tablet arm assembly 50 is as follows. The stowed position 10' depicted in FIG. 5 presents a well-situated location for the tablet when it is not in use. In the stowed position 10', the tablet plate 11 is oriented in a vertical position, perpendicular to the chair seat. The tablet plate mounting ears 13 are located at the top-most end of the tablet plate, which hangs from the pivot pins 15. To re-position the tablet plate to the deployed position 10" depicted in FIG. 4, two steps are required. First, the tablet plate 11 is rotated within the vertical plane, rotating the hub 17 about the short arm 22 of the mounting bar 20. At 180-degrees of rotation, the rotation position at which the mounting ears 13 are located at the bottom-most end of the tablet plate, the spring pins 15 engage the detent bores 35 on the mounting bar 20, resisting further rotation. Second, the tablet plate 11 is pivoted about the pivot pins 15 from the vertical position toward the chair seat until the tablet plate contacts and is supported by the rest bracket 24 in the deployed position 10" depicted in FIG. 2. Completion of the steps and movement of the tablet plate 11 in reverse order will return the tablet plate to the stowed position 10' depicted in FIG. 5.

Figure 6:
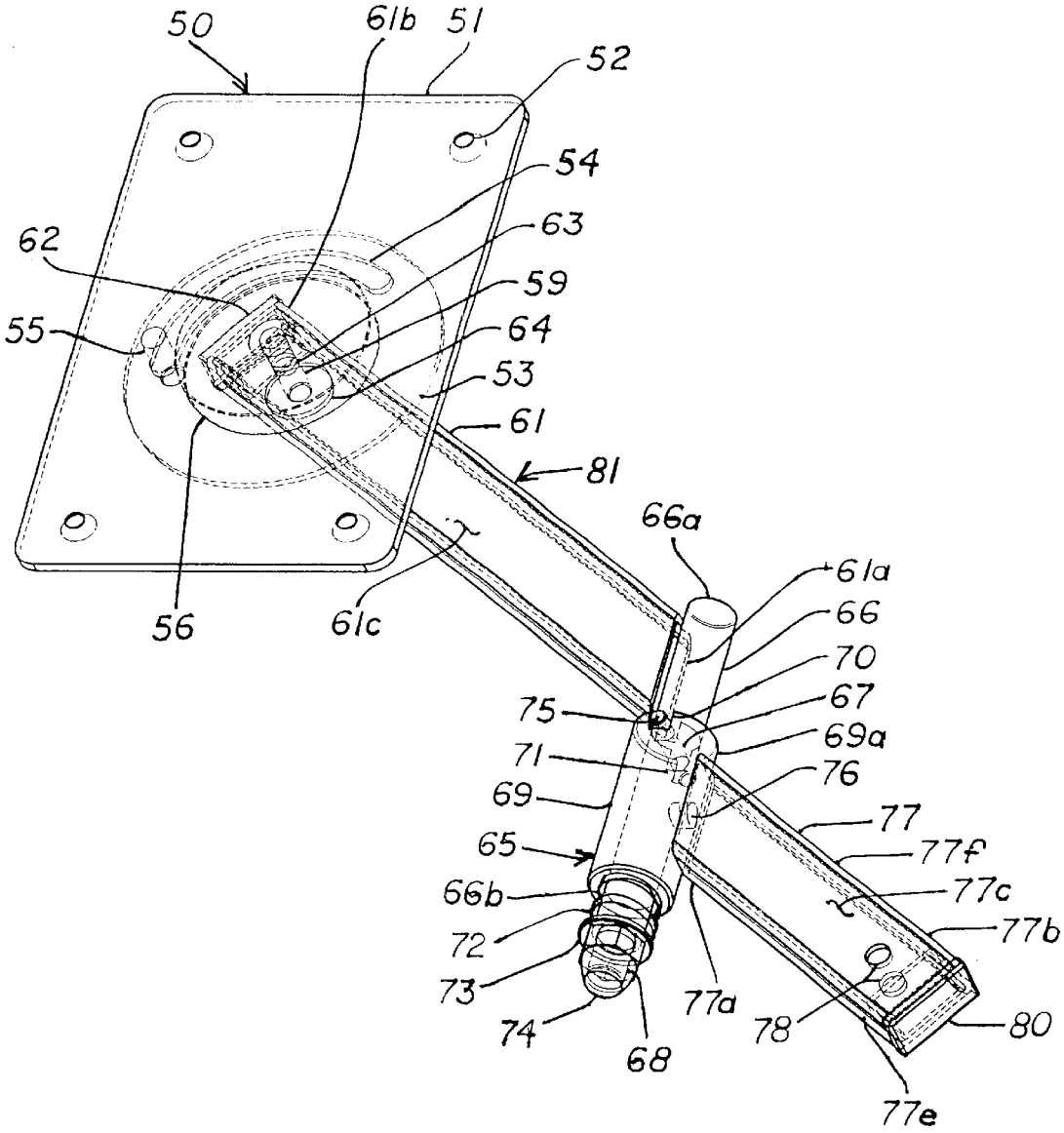
FIG. 6 is a top perspective view of a chair tablet arm apparatus according to a further embodiment of the invention, utilizing an articulating arm assembly.
Figure 7:
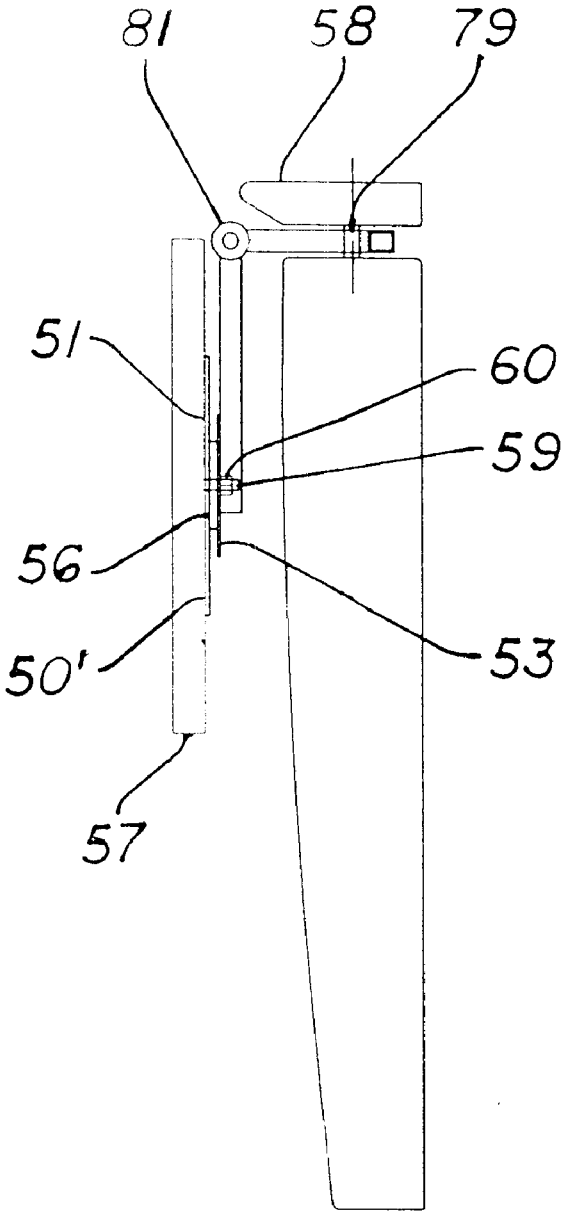
FIG. 7 is a front elevational view of the chair tablet arm apparatus shown in FIG. 6 but integrated into a chair design and shown in a stowed position at the outside of the chair arm.
Figure 8:
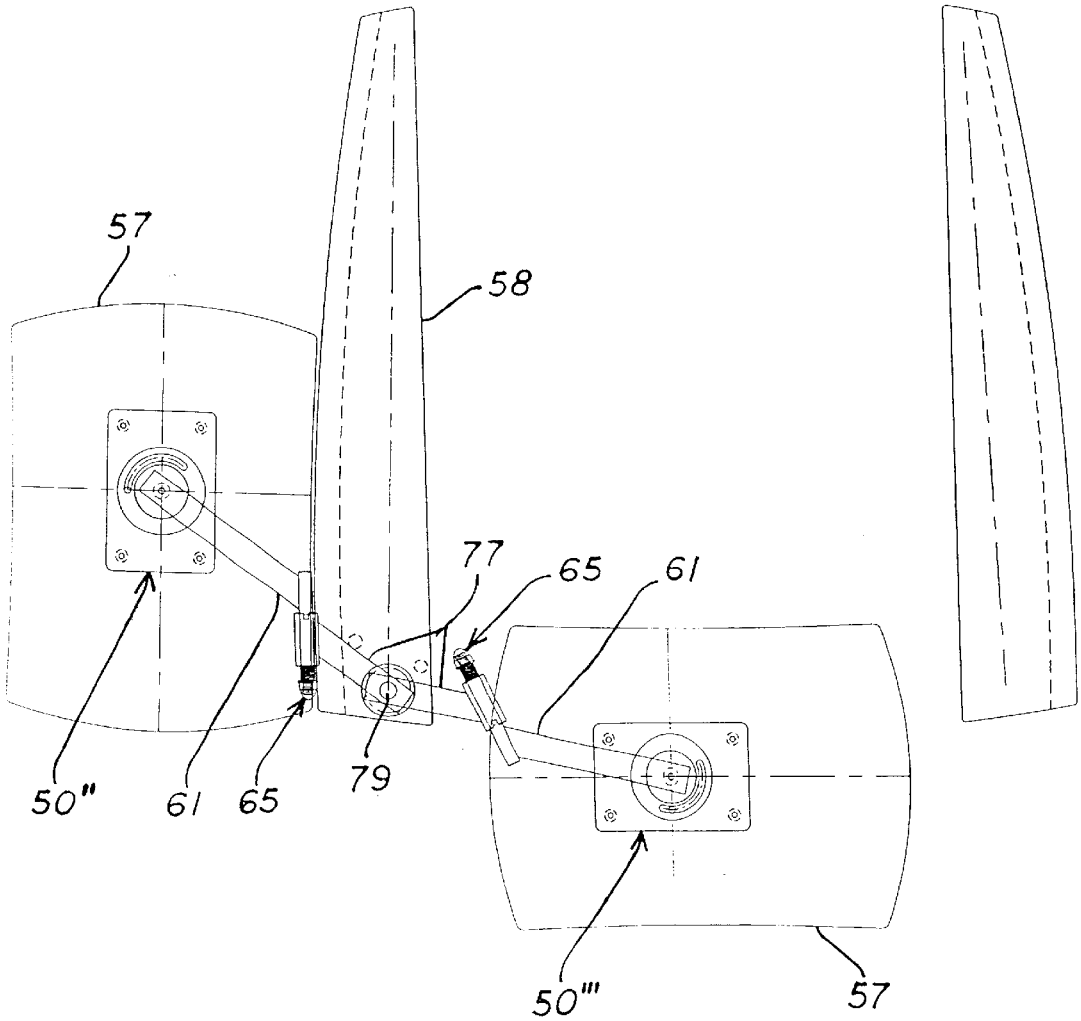
FIG. 8 is a top plan view of a chair tablet arm apparatus shown in FIG. 6, but integrated into a chair design and shown in a deployed position at the outside of the chair arm and in a deployed position above the chair seat.
Figure 9:
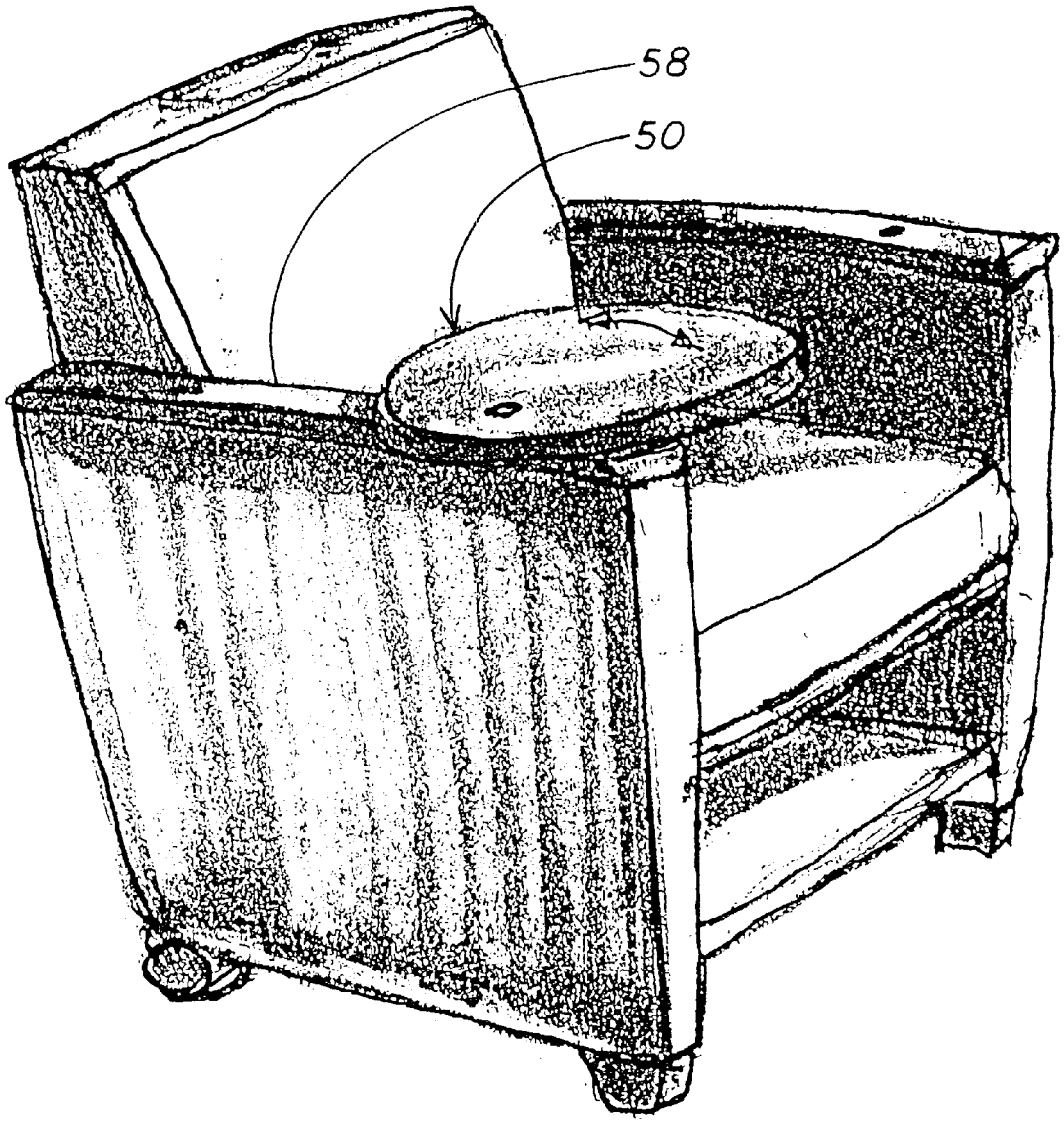
FIG. 9 is a perspective view of a chair tablet arm apparatus shown in FIG. 6 but integrated into a chair design and with the tablet in a deployed position.

In a further embodiment of the invention, as depicted in FIG. 6, a tablet arm apparatus 50 contemplates a tablet plate 51 rotationally attached to an articulating arm assembly 81. The assembly includes a slotted washer 53, a long arm 61, a pivot rod assembly 65, and a short arm 77. The apparatus 50 can be generally constructed of plastic or lightweight metal and can be attached to a member of a chair with the short arm 77, preferably as an integral part of the chair design. The vertical stowed position 50' of the apparatus, at the side of the chair, is depicted in FIG. 7. A first deployed position 50" of the apparatus with tablet plate 51 parallel to the seat of the chair and to the outside of the arm of the chair is depicted in FIG. 8. A second deployed position 50'" above and parallel to the seat of the chair is further depicted in FIG. 8. The first deployed position 50" and stowed position 50' facilitate access to or exit from the seat of the chair. The first and second deployed positions 50" and 50'" each provide a work surface functional to a person seated in the chair.

Referring to FIG. 6, the short arm 77 is pivotally mounted at one end 77*b* to the chair arm 58. The other end 77*a* of the short arm 77 is attached to the pivot sleeve 69 of a pivot rod assembly 65. One end 61*a* of the long arm 61 can be attached to a pivot rod 66 of the pivot rod assembly 65. The pivot rod assembly 65 provides a means for the ends 61*a* and 77*b* of the arms 61 and 77, respectively, which are not attached to pivot rod assembly, to articulate from a position extended and opposite each other, as depicted in FIG. 6, to a position toward each other, as depicted in FIG. 7. The articulating translation allows tablet plate 51 to be rotated from the stowed position 50' depicted in FIG. 7 to the first deployed position 50" along the outside of the chair arm 58, depicted in FIG. 8. The pivotable mounting of the short arm 77, permits the entire tablet arm assembly 50 to pivot between the two deployed positions 50" to 50'", both depicted in FIG. 8.

Referring to FIG. 6, the short arm 77 can be constructed of a section of rectangular tubing. The rectangular shape forms two wider sides 77*c* and 77*d* and two narrower sides 77*e* and 77*f*. Two thru-holes 78 are bored in the wider sides 77*c* and 77*d*, near one end 77*b*, to provide means for pivotably mounting the short arm 77 to a member 58 of the chair (FIG. 8). At the same end 77*b* of the short arm 77 an end cap 80 in inserted to close the open tubing end. The opposite end 77*a* of the short arm 77 is preferably cut at an angle and is attached to pivot sleeve 69 of the pivot rod assembly 65.

The pivot rod assembly 65 includes the pivot rod 66 and pivot sleeve 69, as well as a locking spring 72, a washer 73, and a retaining nut 74. The pivot rod assembly 65 provides a means for the pivot rod 66 to rotate relative to the pivot sleeve 69 and for the resulting articulation of the attached short arm 77 and the attached long arm 61 to stop when the arm assembly is in the extended position depicted in FIG. 6. The cylindrical pivot rod 66 can have an end 66*a* attached to the angled end 61*a* of the long arm 61. The pivot rod 66 extends through the open cylinder formed by the pivot sleeve 69 with each end 66*a* and 66*b* situated beyond the respective end of the pivot sleeve.

In the preferred embodiment, a locking pin 75 extends through a hole 67 bored through a midpoint along the pivot rod 66, with the pin 75 situated adjacent end 69*a* of the pivot sleeve. The pivot rod 66 further includes an opposite threaded end 68 configured for receiving the retaining nut 74. The nut is used to secure the washer 73 and locking spring 72 between the retaining nut 74 and the end 69*b* of the pivot sleeve 69. In this arrangement, the locking spring 72 biases the pivot rod 66 toward the end 69*b* of the pivot sleeve. More specifically, the locking spring biases the pivot rod 66 so that the locking pin 75 can reside within notches 70 and 71 cut in oppose sides of the end 69*a* of the pivot sleeve 69, as shown in FIG. 6. When the locking pin 75 is so situated, the long arm 61 is fixed against rotation relative to the pivot sleeve 69. Rotation is permitted when the pivot rod 66 is pushed toward end 69*a* of the sleeve 69, against the force of the locking spring 72, to thereby release the locking pin 75 from the notches 70 and 71.

The long arm 61 can be constructed of a section of rectangular tubing of the same type as the short arm 77. One end 61*a* of the long arm 61 is angled and attached to an end 66*a* of the pivot rod 66. The other end 61*b* of the long arm 61 can be rotationally connected to the tablet plate 51 using rotational pin 59, support disk 56, a slotted washer 53, and stop pin 55. The long arm 61 can have an end cap 62 enclosing the tube end near the tablet plate 51.

The arm 61 can define a thru-hole 63 sized to receive the rotational pin 59 therethrough. The pin 59 is preferably affixed to the underside of the tablet plate 51, such as by press-fit into a corresponding bore in the plate. Most preferably, the pin passes through a support disk 56 interposed between the tablet plate 51 and the long arm 61, and then through the hole 63 in the arm 61. A retaining cap 64 can engage the pin 59 to fasten the rotational pin, while permitting the pin to rotate relative to the arm 61.

In a further feature of this embodiment, the slotted washer 53 is preferably mounted to the long arm 61, with the support disk 56 disposed between the washer 53 and the tablet plate 51. The washer 53 defines a slot 54 along an arc of a constant radius and extending for less than 360-degrees around the washer. The slotted washer 53 is configured to cooperate with a stop pin 55 extending from the underside of the tablet plate 51. In other words, the stop pin 55 rides within the slot 54 of the washer to control the range of rotational movement of the tablet plate 51 relative to the long arm 61. Preferably, the slot 54 extends along an arc of about 135-degrees so that the user can find a comfortable orientation of the tablet plate in use. The tablet plate 51 can define multiple mounting holes 52 therethrough by which a work surface can be attached.

The operation of the chair tablet articulating arm assembly 50 is as follows. The stowed position 50' depicted in FIG. 7 presents a well-situated location for the tablet when it is not in use. In the stowed position 50', the tablet plate 51 can be oriented in a vertical position, perpendicular to the chair seat. To re-position the tablet plate 51 to the first deployed position 50", depicted in FIG. 8, the tablet plate can be translated to the horizontal position, parallel to the chair seat, by the pivoting of the long arm 61 at the pivot rod assembly 65, until the locking pin 75 engages the locking notches 70 and 71. The tablet plate 51 is thereby located outside the chair arm 58, at position 50" depicted in FIG. 8.

To re-position the tablet plate 51 over the seat of the chair, such as in the second deployed position 50''' depicted in FIG. 8, the entire arm assembly can be simply rotated about the pivotable mounting fastener 79 located near the end of short arm 77. Completion of the steps and movement of the assembly in reverse order can return the tablet plate to the stowed position 50' depicted in FIG. 7.

While the invention has been illustrated and described in detail in the drawings and foregoing description, the same is to be considered as illustrative and not restrictive in character. It should be understood that only the preferred embodiments have been shown and described and that all changes and modifications that come within the spirit of the invention are desired to be protected.

What is claimed is:

1. A tablet arm apparatus for supporting a work surface on an article of furniture, the apparatus comprising:

a mounting bar having a first arm and a substantially perpendicularly disposed second arm;

a clamp having a portion attached to said second arm and configured to engage a member of the article of furniture to support said tablet arm apparatus thereon;

a pivot hub rotatably mounted on said first arm of said mounting bar;

a tablet plate configured for supporting the work surface and including at least one mounting ear; and means for pivotably attaching said at least one mounting ear to said pivot hub to permit pivoting of said tablet plate relative to said pivot hub, whereby said tablet plate is also rotatable with said pivot hub relative to said mounting bar.

2. The tablet arm apparatus according to claim 1, wherein:

said tablet plate includes two mounting ears defining a U-shape opening to receive said pivot hub therebetween; and said means for pivotably attaching includes;

a pair of pin bores defined in said pivot hub at opposite sides thereof; and a pair of pins, one each projecting from a corresponding one of said two mounting ears and pivotably disposed within a corresponding one of said pair of pin bores.

3. The tablet arm apparatus according to claim 2, wherein:

said pivot hub defines a central opening therethrough for rotatably mounting said pivot hub on said first arm;

said pin bores intersect said central opening;

said first arm of said mounting bar defines at least a pair of oppositely disposed detents; and said pins are spring pins configured for spring biased engagement within a corresponding one of said detents when said tablet plate and pivot hub are rotated to a position in which said pins are aligned with said detents.

4. The tablet arm apparatus according to claim 1, wherein said clamp includes:

a first C-clamp portion attached to said second arm and defining a first cylinder portion;

a second C-clamp portion defining a second cylinder portion, whereby said first and second cylinder portions can be juxtaposed about the member of the article of furniture; and a number of fasteners for clamping said first and second C-clamp portions together with said first and second cylinder portions engaged about the member of the article of furniture.

5. The tablet arm apparatus according to claim 1, further comprising a rest bracket mounted on said first arm adjacent said pivot hub, said rest bracket defining a surface for supporting said tablet plate when said plate is in a deployed position.

6. The tablet arm apparatus according to claim 1, wherein said pivot hub is composed of a low-friction material.

7. A tablet arm apparatus for supporting a work surface on an article of furniture, the apparatus comprising:

a first arm having a first end and an opposite second end, said second end defining means for pivotably mounting said first arm to the article of furniture;

a second arm having a first end and an opposite second end;

a tablet plate mounted to said second end of said second arm;

a pivot rod assembly including a pivot sleeve and a pivot rod rotatably disposed within said pivot sleeve, wherein the first end of one of said first arm and said second arm is connected to said pivot sleeve, and the first end of the other of said first arm and said second arm is connected to said pivot rod;

wherein at least one notch is defined at one end of said pivot sleeve; and wherein a locking pin is mounted on said pivot rod and is configured to be received within said at least one notch to prevent relative rotation between said pivot rod and said pivot sleeve.

8. The tablet arm apparatus according to claim 7, wherein:

said pivot rod has a first and an opposite second end, with said locking pin disposed adjacent to said first end of said pivot rod and said one end of said pivot sleeve;

said pivot rod being rotatably and slidably disposed within said pivot sleeve; and said pivot rod assembly further includes a biasing spring acting between said second end of said pivot rod and an end of said pivot sleeve opposite said one end and operable to bias said locking pin into said at least one notch when said pivot rod is rotated relative to said pivot sleeve to a position in which said locking pin is aligned with said at least one notch.

9. A tablet arm apparatus for supporting a work surface on an article of furniture, the apparatus comprising:

a first arm having a first end and an opposite second end, said second end defining means for pivotably mounting said first arm to the article of furniture;

a second arm having a first end and an opposite second end;

a tablet plate mounted to said second end of said second arm;

a pivot rod assembly including a pivot sleeve and a pivot rod rotatably disposed within said pivot sleeve, wherein the first end of one of said first arm and said second arm is connected to said pivot sleeve, and the first end of the other of said first arm and said second arm is connected to said pivot rod;

a washer affixed to said second end of said second arm, said washer defining an arcuate slot therein;

means for rotatably fastening said tablet plate to said second end of said second arm; and a stop pin projecting from said tablet plate and into said arcuate slot, whereby said arcuate slot limits the range of rotation of said tablet plate relative to said second arm.

* * * * *